US011495424B2

(12) United States Patent
Satoh et al.

(10) Patent No.: US 11,495,424 B2
(45) Date of Patent: Nov. 8, 2022

(54) DC CIRCUIT BREAKER

(71) Applicant: UBUKATA INDUSTRIES CO., LTD., Nagoya (JP)

(72) Inventors: Shigemi Satoh, Nagoya (JP); Shigehisa Ishii, Nagoya (JP)

(73) Assignee: UBUKATA INDUSTRIES CO., LTD., Nagoya (JP)

( * ) Notice: Subject to any disclaimer, the term of this patent is extended or adjusted under 35 U.S.C. 154(b) by 0 days.

(21) Appl. No.: 16/972,261

(22) PCT Filed: Sep. 20, 2018

(86) PCT No.: PCT/JP2018/034858
§ 371 (c)(1),
(2) Date: Dec. 4, 2020

(87) PCT Pub. No.: WO2020/059086
PCT Pub. Date: Mar. 26, 2020

(65) Prior Publication Data

US 2021/0241987 A1 Aug. 5, 2021

(51) Int. Cl.
*H01H 37/32* (2006.01)
*H01H 33/04* (2006.01)
*H01H 33/59* (2006.01)

(52) U.S. Cl.
CPC ..... *H01H 37/32* (2013.01); *H01H 33/04* (2013.01); *H01H 33/596* (2013.01)

(58) Field of Classification Search
CPC ..... H01H 37/32; H01H 37/02; H01H 37/54; H01H 37/64; H01H 2037/5454;
(Continued)

(56) References Cited

U.S. PATENT DOCUMENTS 4,306,210 A * 12/1981 Saur ..... H01H 37/32 337/107
4,843,364 A * 6/1989 Place ..... H01H 1/5866 200/284

(Continued)

FOREIGN PATENT DOCUMENTS

JP H08171846 A 7/1996
JP 2001189120 A 7/2001

(Continued)

OTHER PUBLICATIONS

Translation of JP2016143559 (Original document published Aug. 8, 2016) (Year: 2016).*

(Continued)

*Primary Examiner* — William A Bolton
(74) *Attorney, Agent, or Firm* — Karceski IP Law, PLLC

(57) ABSTRACT

A DC circuit breaker includes a case, two fixed contacts, two movable contacts, a bypass plate electrically connecting the two movable contacts, a moving block to move the bypass plate, a moving block biasing member to bias the moving block in a direction away from the fixed contacts, a thermally responsive member, a latch, a shutter, and a shutter biasing member. The thermally responsive member deforms when an installation surface equals or exceeds a prescribed temperature. The latch restricts movement of the moving block by locking the moving block when the thermally responsive member is in a pre-deformation state. The latch cancels the restriction of the movement the thermally responsive member deforms. The shutter is insertable between the fixed contacts and the movable contacts. The shutter biasing member constantly biases the shutter in a direction to be inserted between the fixed contacts and the movable contacts.

10 Claims, 16 Drawing Sheets

(58) Field of Classification Search
CPC .. H01H 2037/549; H01H 33/04; H01H 33/06; H01H 33/596; H01H 1/20; H01H 9/32
USPC ..... 218/146; 337/107, 348, 343, 330
See application file for complete search history.

(56) References Cited

U.S. PATENT DOCUMENTS

| | | | | |
|---|---|---|---|---|
| 6,891,464 | B2 * | 5/2005 | Scott | H01H 37/54 337/333 |
| 7,298,239 | B2 * | 11/2007 | Yamada | H01H 81/02 337/107 |
| 9,972,470 | B2 * | 5/2018 | Adake | H01H 85/055 |
| 2013/0057381 | A1 * | 3/2013 | Kandhasamy | H01H 37/52 337/348 |

FOREIGN PATENT DOCUMENTS

| | | | |
|---|---|---|---|
| JP | 2002150905 | A | 5/2002 |
| JP | 2004288604 | A | 10/2004 |
| JP | 2005019160 | A | 1/2005 |
| JP | 2012212543 | A | 11/2012 |
| JP | 2016143559 | A | 8/2016 |
| JP | 2016177891 | A | 10/2016 |

OTHER PUBLICATIONS

Indian Office Action dated Jul. 27, 2021, for Indian Patent Application No. 202047052668.
International Search Report dated Dec. 18, 2018, for International Patent Application No. PCT/JP2018/034858.
Chinese Office Action dated Mar. 30, 2022, for Chinese Patent Application No. 2018800915524.
Extended European Search Report dated Mar. 7, 2022, for European Patent Application No. 18934327.0.
Korean Office Action dated Jun. 28, 2022, for Korean Patent Application No. 10-2020-7026770.

* cited by examiner

DC CIRCUIT BREAKER

CROSS-REFERENCE TO RELATED APPLICATION(S)

This is a National Stage Entry into the United States Patent and Trademark Office from International Patent Application No. PCT/JP2018/034858, filed on Sep. 20, 2018, the entire content of which is incorporated herein by reference.

FIELD OF THE INVENTION

Embodiments of the present invention relate to a DC circuit breaker.

BACKGROUND OF THE INVENTION

Recently, high-voltage DC power supplies have been used in temperature control devices for cooling electric circuits such as cooling and heating devices provided in the room of electric vehicles and batteries. In such devices, when abnormal current flows through the circuit due to collision accidents, it may lead to serious accidents such as firing due to the heat caused by overcurrent. Thus, DC circuit breakers were required in these devices to reliably cut off current. It is also required for these DC circuit breakers to be compact and simply structured when they are installed in a limited space such as an engine room of an automobile because it is difficult to secure installation space.

However, in order to reliably extinguish arc generated when cutting off high-voltage DC current in such DC circuit breakers, it was required to, for example, separate the contacts by a sufficient distance or provide an arc extinguisher to disperse the generated arc. It was therefore difficult to reduce the size of the circuit breaker. Further, the components of the circuit breaker become smaller with the downsizing of the circuit breaker. As a result, it becomes difficult to assemble the circuit breaker which tends to reduce productivity.

SUMMARY OF THE INVENTION

Thus, there is provided a DC circuit breaker capable of reliably cutting off high-voltage DC current and which is further downsized and improved in productivity.

A DC circuit breaker of an embodiment is provided with a case formed of an electrically insulative material; two fixed contacts fixed within the case; two movable contacts each provided so as to correspond to each of the two fixed contacts; a bypass plate having the two movable contacts fixed thereto and electrically connecting the two movable contacts; a moving block having a groove in which the bypass plate is disposed and being provided so as to be movable in a direction to move away from the fixed contacts within the case, the moving block being configured to move the bypass plate in a direction to move away from the fixed contacts when moving in the direction to move away from the fixed contacts; a moving block biasing member configured to constantly bias the moving block in the direction to move away from the fixed contacts; a thermally responsive member provided in a position opposing an installation surface and configured to deform when the installation surface becomes equal to or greater than a prescribed temperature; a latch having a locking portion configured to restrict movement of the moving block by locking the moving block when the thermally responsive member is in a pre-deformation state, the latch being configured to operate to cancel the restriction of the movement of the moving block by unlocking the locking portion from the moving block in response to a deformation of the thermally responsive member; a shutter formed of an electrically insulative material and configured to be inserted between the fixed contacts and the movable contacts when the movable contacts are separated from the fixed contacts; and a shutter biasing member configured to constantly bias the shutter in a direction to be inserted between the fixed contacts and the movable contacts.

DESCRIPTION OF EMBODIMENT(S) THE INVENTION

An embodiment will be described hereinafter with reference to the drawings.

Figure 1:
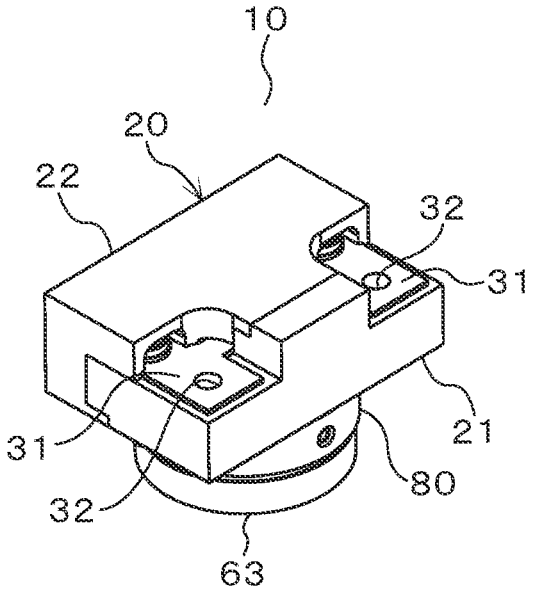
FIG. 1 is a perspective view illustrating one example of an external structure of a DC circuit breaker according to one embodiment.
Figure 2:
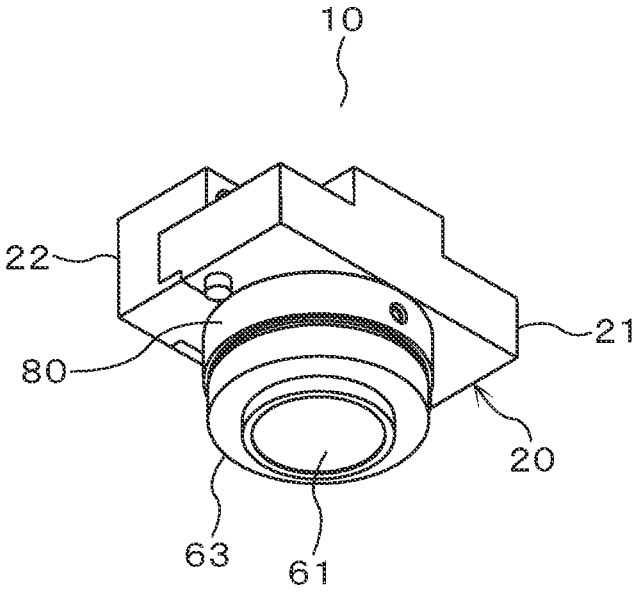
FIG. 2 is a perspective view illustrating one example of an external structure of the DC circuit breaker according to one embodiment seen from a direction different from that of FIG. 1.
Figure 3:
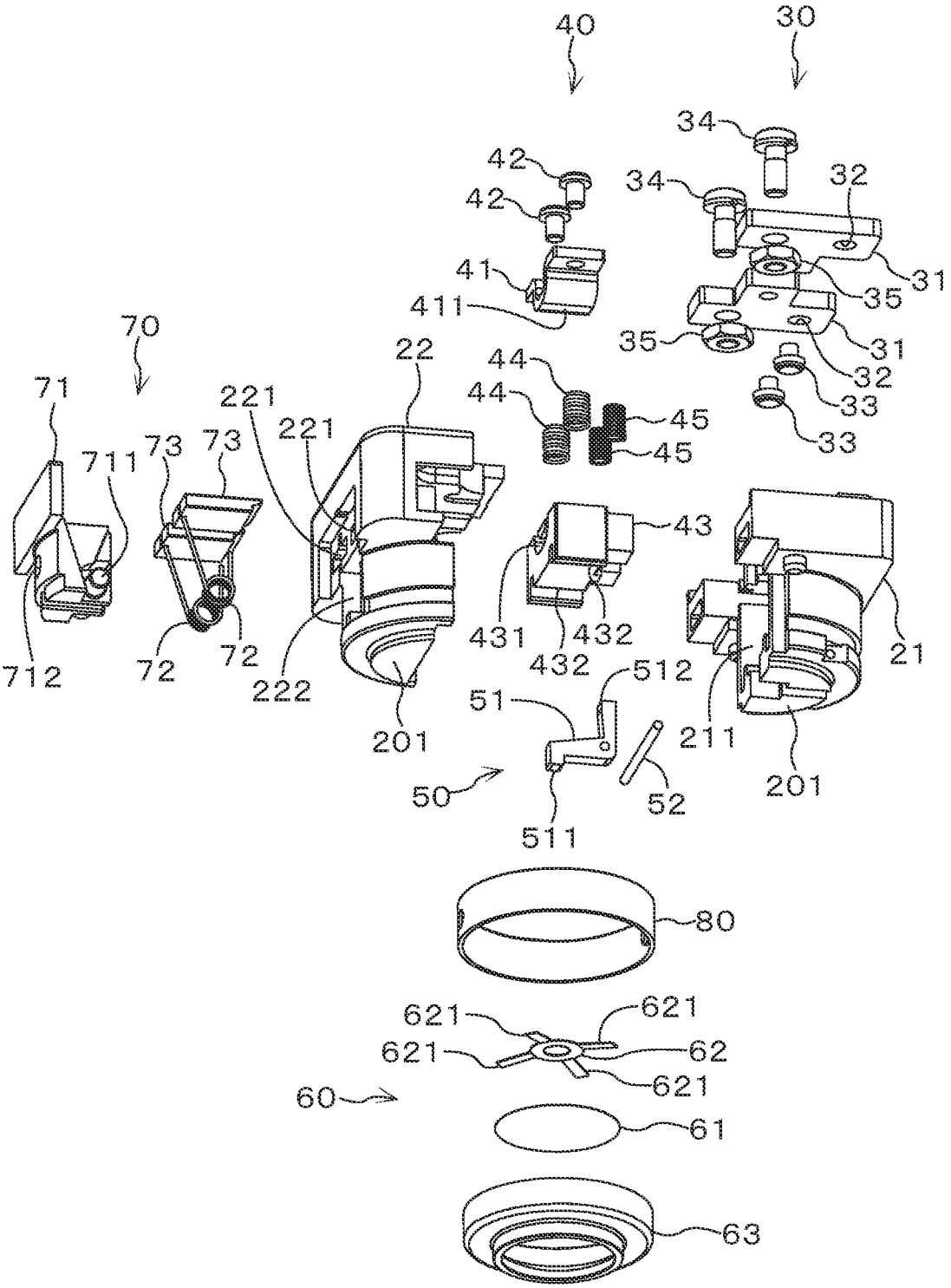
FIG. 3 is an exploded perspective view illustrating one example of an external structure of the DC circuit breaker according to one embodiment.

A description will be given on one example of a construction of a DC circuit breaker 10 according to an embodiment. The DC circuit breaker 10 is a thermally responsive DC circuit breaker and operates to cut off current when abnormal heating is detected by the host device. As shown in FIGS. 1 to 3, the DC circuit breaker 10 is provided with a case 20, a fixed electrode mechanism 30, a movable electrode mechanism 40, a latch mechanism 50, a trigger mechanism 60, a shutter inserting mechanism 70, and a securing ring 80.

The case 20 constitutes the outer housing of the DC circuit breaker 10 and is formed of electrically insulative material such as resin. Electrically insulative resin such as PPS (Polyphenylene sulfide) resin, UP (unsaturated polyester), PBT (polybutyleneterephtalate), and ABS; and inorganic insulating material such as ceramics, for example, are selected as appropriate as the material of the case 20 depending upon the environment in which the DC circuit breaker 10 is used. The case 20 is divided into multiple, in this case, two cases. In this example, the case 20 is configured by a combination of a first case 21 and a second case 22.

Figure 4:
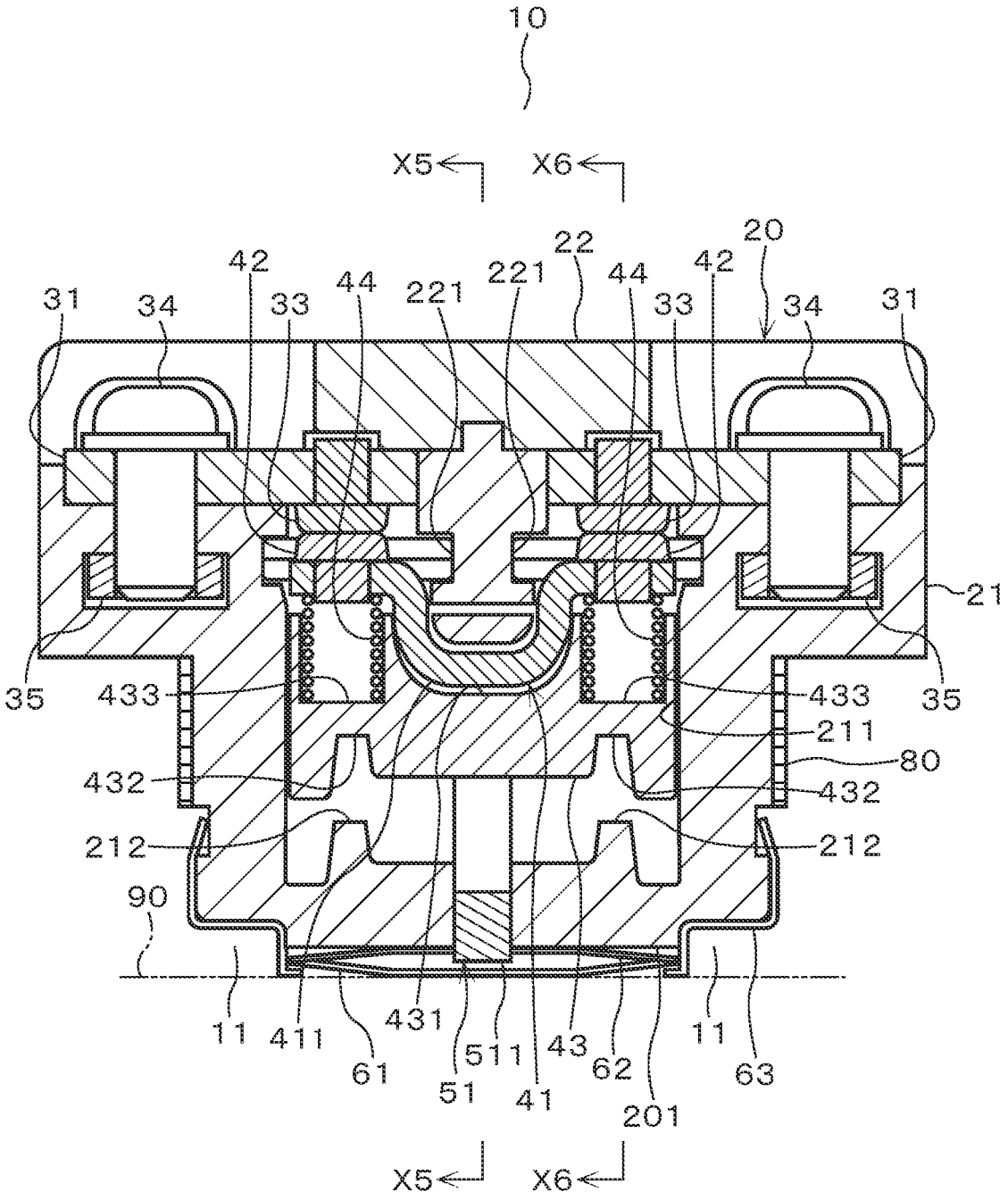
FIG. 4 is a cross sectional view illustrating one example of an internal structure of the DC circuit breaker in a pre-operating state according to one embodiment.

As shown in FIG. 3, for example, the fixed electrode mechanism 30 is provided with two terminal plates 31, two wire connectors 32, and two fixed contacts 33. One terminal plate 31, one wire connector 32, and one fixed contact 33 constitute one set of components. The terminal plate 31 is formed of an electrically conductive material such as copper or copper alloy. The terminal plate 31 comes in a plate form and is mounted on the case 20, in this example, the first case 21. A part of the terminal plate 31 is exposed from the first case 21. As also shown in FIG. 4, the terminal plate 31 is secured to the case 20, in this example, the first case 21, by a bolt 34 and a nut 35 for example.

The wire connector 32 is configured, for example, as a hole extending through the terminal plate 31 and is exposed from the case 20. The wire connector 32 may be formed as a hole with or without a female thread. The wires of the device whose circuit is to be cut off by the circuit breaker 10 are connected to the wire connector 32. For example, the wires of the device are provided with a male thread terminal which is threaded into the wire connector 32 or is secured to the wire connector 32 by being fastened by a nut. The wire connector 32 may be provided, for example, with a terminal such as a male thread or a stud terminal.

The fixed contact 33 is formed of an electrically conductive material primarily composed of silver for example. Clad materials such as silver oxide and copper or copper alloy are selected as appropriate as the material of the fixed contact 33 depending upon the environment in which the DC circuit breaker 10 is used. The fixed contact 33 is fixed to the terminal plate 31 so as to face the direction opposite the wire connector 32. Thus, the fixed contact 33 is fixed so as to be stored inside the case 20, in this example, inside the first case 21. The fixed contact 33 is configured so as to be unmovable within the case 20.

As shown in FIG. 3, the movable electrode mechanism 40 is provided with one bypass plate 41, two movable contacts 42, one moving block 43, two pressure spring 44, and two separating springs 45. The bypass plate 41 is formed into a plate shape by an electrically conductive material such as a clad material formed of copper or copper alloy. The rigidity of the bypass plate 41 is set so that it does not deform under normal use. As shown in FIG. 4, the bypass plate 41 is formed by bending an elongate plate in a U shape so that its mid portion in the longer side direction protrudes in a direction opposite the fixed contacts 33 and the ends of the two parallelly arranged linear portions are connected. The portion of the bypass plate 41 curved in the U shape is referred to as a curved portion 411.

The movable contact 42 is formed of an electrically conductive material such as copper and copper alloy as was the case for the fixed contact 33. The two movable contacts 42 are each fixed to each of the two ends provided at the longer side direction of the bypass plate 41. Each of the movable contacts 42 face the fixed contact 33 as viewed from the bypass plate 41. The moving block 43 is stored so as to be movable within the case 20, in this example, within the first case 21. In the present embodiment, the moving block 43 is configured to be movable, for example, in the downward direction as viewed in the page of FIG. 4.

As shown in the drawings such as FIG. 4, the first case 21 is provided with a moving block housing 211, storing the moving block 43, and a protrusion 212. The moving block housing 211 is a space for storing the moving block 43 in a movable state. The moving block 43 is stored in the moving block housing 211 provided in the first case 21. The moving block 43, guided by the wall of the moving block housing 211, is movable in the direction moving away from the fixed contact 33. The position of the moving block 43 in which the movable contact 42 is placed in contact with the fixed contact 33 is defined as the starting position. The position of the moving block 43 in which the movable contact 42 is most distant from the fixed contact 33 is defined as the terminating position of the moving block 43.

The protrusion 212 is provided on a surface located on a terminating side of the moving block 43 and protrudes toward the moving block 43. In the present embodiment, the first case 21 is provided with two protrusions 212. The two protrusions 212 are provided at positions symmetrical to a plane passing through the center of gravity of the moving block 43 and extending along the direction of movement of the moving block 43. That is, the two protrusions 212 are provided in positions symmetrical to the lateral center of the moving block 43 as viewed in FIG. 4. Further in the present embodiment, the two protrusions 212 are each provided at positions corresponding to each of the two movable contacts 42. That is, the protrusion 212 and the movable contact 42 are disposed on a straight line extending along the direction of movement of the moving block 43.

As shown in FIGS. 4 to 6 and FIG. 10, the moving block 43 is provided with a groove 431, two cavities 432, two pressing spring housings 433, and two separating spring housings 434. The groove 431 is formed into a U shape and extends along the curved portion 411 located in the middle portion of the bypass plate 41 as viewed in the longer side direction of the bypass plate 41. The groove 431 is dug in a direction orthogonal to the direction in which the moving block 43 is moved. The curved portion 411 of the bypass plate 41 is inserted into the groove 431 of the moving block 43. A gap extending in the moving direction of the moving block 43 is created between the bypass plate 41 and the groove 431 when the bypass plate 41 is inserted into the groove 431. The gap allows the bypass plate 41 to relatively move with respect to the moving block 43.

Figure 7:
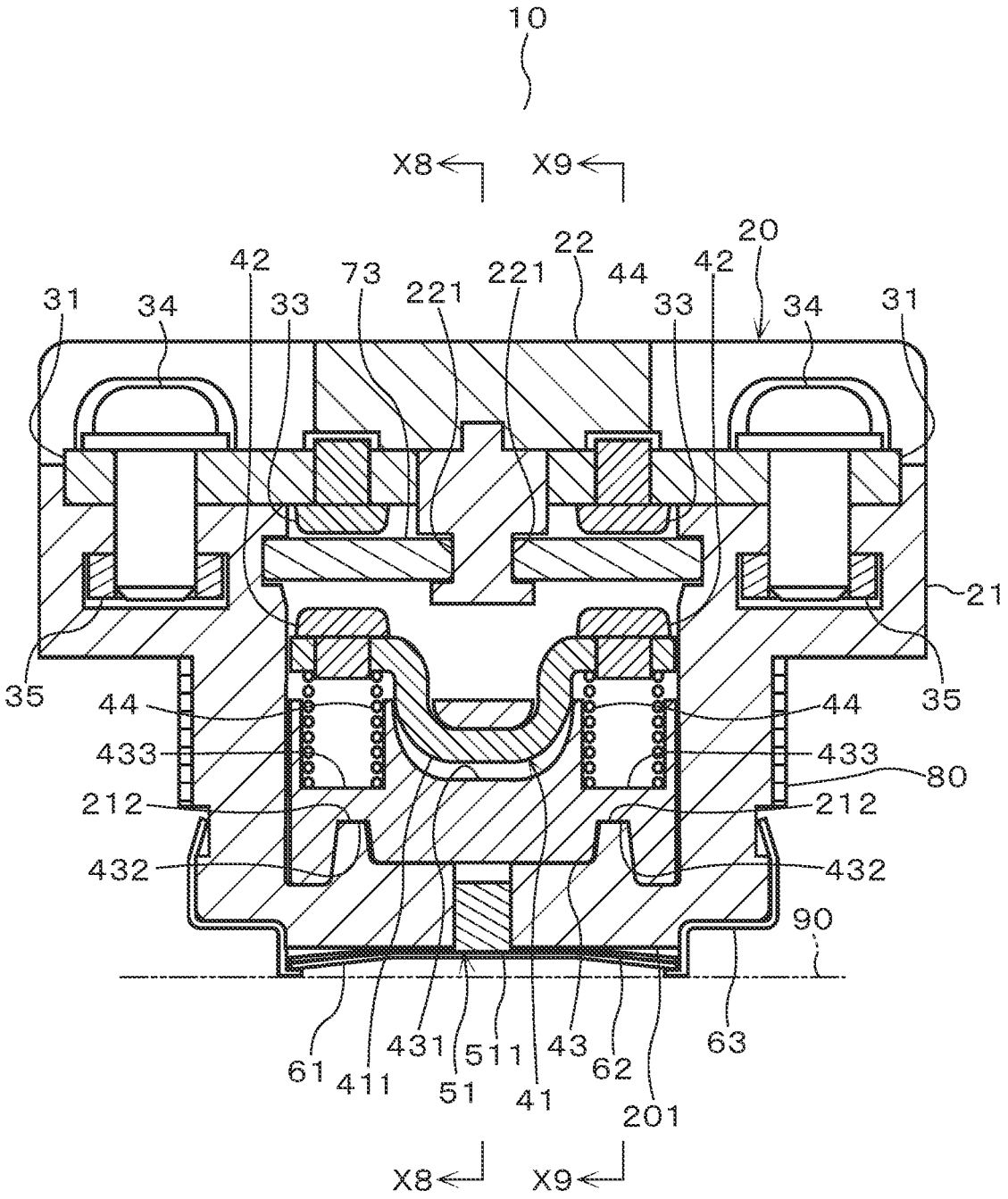
FIG. 7 is a cross sectional view illustrating one example of an internal structure of the DC circuit breaker in a post-operating state according to one embodiment.

The U-shaped curved portion 411 of the bypass plate 41 has parallelly disposed linear portions that extend along the moving direction of the moving block 43. The U-shaped groove 431 has linear portions extending along the moving direction of the moving block 43 and the linear portions of the curved portion 411 are inserted into the linear portions of the groove 431. Thus, when the bypass plate 41 tries to move in the direction orthogonal to the moving direction of the moving block 43, that is, in the lateral direction of the page of FIGS. 4 and 7, the linear portions of the curved portion 411 extending in the moving direction of the moving block 43 contact the inner surface of the groove 431. As a result, the movement of the bypass plate 41 in the direction orthogonal to the moving direction of the moving block 43, that is, the lateral direction of the page of FIGS. 4 and 7 is restricted.

In this example, the groove 431 is formed into a U shape. However, the groove 431 is not limited to a U shape conforming with the U shape of the curved portion 411 of the bypass plate as long as a gap can be created in the moving direction of the moving block 43 and the bypass plate 41 can be retained so as not to be removed from the moving block 43 by the bias of the contact pressing spring 44 when the contact is opened.

The cavities 432 are provided on a surface of the moving block 43 located on a side opposite the fixed contact 33, that is, on a surface located in the moving direction side of the moving block 43. The two cavities 432 each correspond to each of the two protrusions 212 provided on the first case 21. The protrusions 212 fit into the cavities 432 when the moving block 43 moves to the terminating position. It is thus, possible to prevent the moving block 43 from temporarily bouncing back toward the fixed contact 33 side when the moving block transports rapidly and impinges on the wall in the terminating side of the moving block housing 211. Hence, it is possible to prevent the distance between the fixed contact 33 and movable contact 42 from being reduced when the contacts are opened and thereby prevent the arc from being sustained or be regenerated after being once extinguished.

The pressing spring housing 433 is formed on the moving block 43 by cylindrically digging a surface of the moving block 43 in the movable contact 42 side towards the moving direction of the moving block 43. The pressing spring housing 433 stores and supports a part of the pressing spring 44. Two pressing spring housings 433 are each provided in a position corresponding to each of the two movable contacts 42. That is, the movable contacts 42 and the pressing spring housings 433 are disposed on the line extending along the moving direction of the moving block 43.

The separating spring housing 434 is formed on the moving block 43 by cylindrically digging a surface of the moving block 43 in the movable contact 42 side towards the moving direction of the moving block 43. The separating spring housing 434 stores and supports a part of the separating spring 45. The two separating spring housings 434 are disposed in a position displaced with respect to the direction in which the two pressing spring housings 433 are disposed. That is, each of the two separating spring housings 434 are disposed in a position displaced in the lateral direction which is orthogonal to the direction normal to the page of FIG. 6. In other words, the two separating spring housings 434 are disposed in a position which is displaced from the gravity center of the moving block 43.

The pressing spring 44 is formed of a compression coil spring, for example, and serves as a movable contact biasing member configured to bias the movable contact 42 provided at the bypass plate 41 in a direction to press the fixed contact 33. The pressure spring 44 are provided so as to correspond to the two movable contacts 42. The pressure spring 44 are provided on the bypass plate 41 so as to be located in the side opposite the fixed contacts 33 and are disposed between the bypass plate 41 and the moving block 43.

The pressing spring 44 is stored in the pressing spring housing 433 with a part of the pressing spring 44 protruding from the pressing spring housing 433. A first end of the pressing spring 44 is supported by the bottom of the pressing spring housing 433 and a second end of the pressing spring 44 supports a surface of the bypass plate 41 located on a side opposite the movable contacts 42. The pressing spring 44 is not limited to a compression coil spring as long as it is capable of biasing the movable contacts 42 provided at the bypass plate 41 in a direction to press the fixed contacts 33.

The separating spring 45 is formed of a compression coil spring, for example, and serves as a moving block biasing member configured to bias the moving block 43 in a direction moving away from the fixed contacts 33. That is, the separating spring 45 imparts moving force to the moving block 43, bypass plate 41, and the movable contacts 42 which moving force is exerted in a direction to move the moving block 43, the bypass plate 41, and the movable contacts 42 away from the fixed contacts 33.

The separating springs 45 are provided so as to correspond to the two movable contacts 42. The separating spring 45 is provided between the moving block 43 and the wall of the case 20. In this example, the separating spring 45 is provided between the moving block 43 and the wall of the first case 21. A first end of the separating spring 45 is supported by the bottom of the separating spring housing 434 and a second end of the separating spring 45 is supported by a wall provided within the moving block housing 211 of the first case 21. Thus, the separating spring 45 constantly biases the moving block 43 in a direction to move away from the fixed contacts 33.

The two separating spring housings 434 are each disposed in a position displaced from the gravity center of the moving block 43. Consequently, the separating spring 45 is also disposed in a position displaced from the gravity center of the moving block 43. When the elastic force of the pressing spring 44 is ignored, a rotational force having the gravity center of the moving block 43 as the rotational center is exerted on the moving block 43 by the elastic force received by the separating spring 45. As a result, the moving block 43 gets caught on the inner wall of the moving block housing 211 and thereby inhibits the smooth movement of the moving block 43.

Thus, in the present embodiment, the elastic force of the separating spring 45 is set so as to be less than the elastic force of the pressing spring 44. That is, the sum of the biasing force of the two pressure spring 44, serving as the movable contact biasing member, is set so as to be greater than the sum of the biasing force of the two separating springs 45, serving as the moving block biasing member. Thus, the pressing spring 44 exerts force oriented in a direction to cancel the rotational force exerted by the separating spring 45 in the initial stage of movement of the moving block 43. Consequently, rotation of the moving block 43 is suppressed in the initial stage of movement of the moving block 43. As a result, the moving block 43 is inhibited from being caught on the inner wall of the moving block housing 211 to allow smooth movement of the moving block 43.

The latch mechanism 50 is configured to control the behavior of the movable electrode mechanism 40, that is, the movement of the moving block 43. As shown in FIG. 3, the latch mechanism 50 is provided with a latch 51 and a latch shaft 52. The latch 51 is formed of an aluminum alloy or brass, for example. The latch shaft 52 is formed of stainless steel or carbon steel. The latch 51 and the latch shaft 52 may be formed of materials such as resin and other metals as long as such materials exhibit sufficient mechanical strength.

Figure 5:
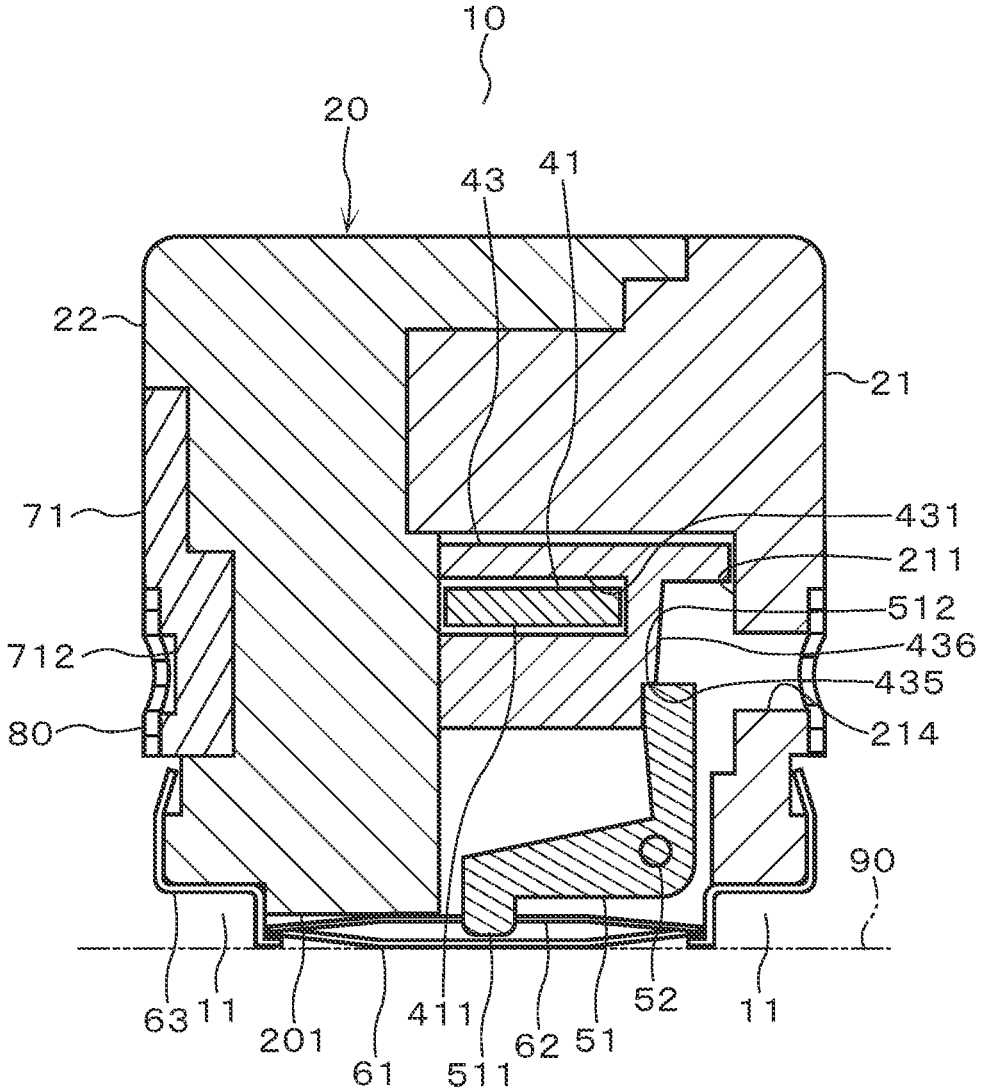
FIG. 5 is a cross sectional view taken along line X5-X5 of FIG. 4 illustrating one example of an internal structure of the DC circuit breaker in a pre-operating state according to one embodiment.

As illustrated in the drawings such as in FIG. 5, the latch 51 is formed into a so called L-shape bent orthogonally as a whole. As illustrated in the drawings such as in FIG. 5, the latch shaft 52 is passed through the L-shaped bent portion of the latch 51. The latch 51 and the latch shaft 52 may be formed integrally. The latch 51 is stored within the case 20, in this example, within the first case 21 with the latch shaft 52 passed therethrough. The two ends of the latch shaft 52 are each supported by a bearing not shown provided at the first case 21.

The latch 51 is provided with a receiving portion 511 and a locking portion 512. The receiving portion 511 is provided on a first end of the L-shaped latch 51. The receiving portion 511 is configured to receive operating force of the latch 51 from the trigger mechanism 60. The locking portion 512 is provided on a second end of the L-shaped latch 51. The locking portion 512 is configured to lock the moving block 43. The moving block 43 is provided with a locked portion 435. The locked portion 435 is formed by notching a portion of a part located in the opposite side of the fixed contact 33 in a stepped shape. The latch 51 restricts the movement of the moving block 43 by the locking of the locking portion 512 of the latch 51 with the locked portion 435 of the moving block 43. When the latch 51 rotates in the direction indicated by the white box arrow shown in FIG. 11, the locking portion 512 becomes unlocked from the locked portion 435 of the moving block 43 to cancel the restriction of the movement of the moving block 43.

Figure 11:
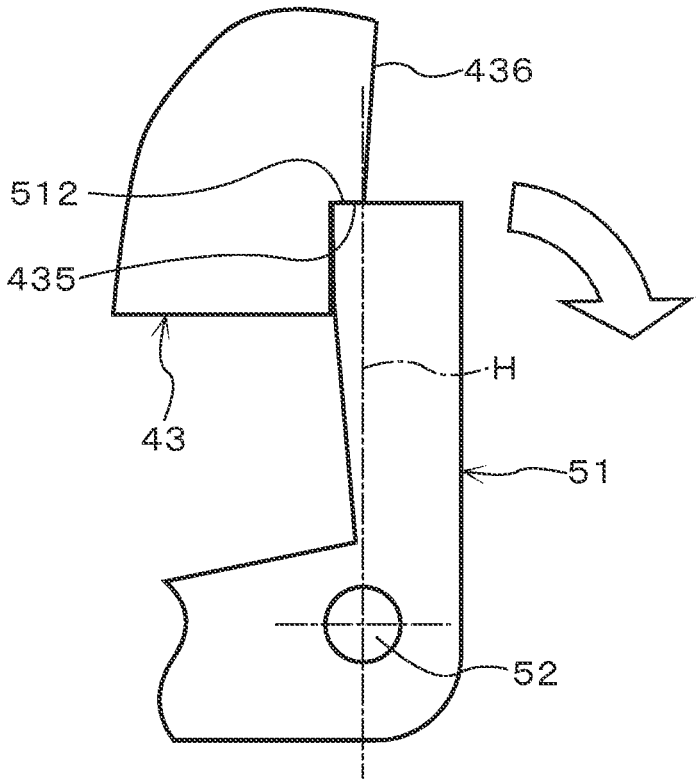
FIG. 11 illustrates one example of an internal structure of the DC circuit breaker in the pre-operating state and provides an enlarged view indicating the positional relationship between a locking portion of a latch and a locked portion of the moving block according to one embodiment.
Figure 12:
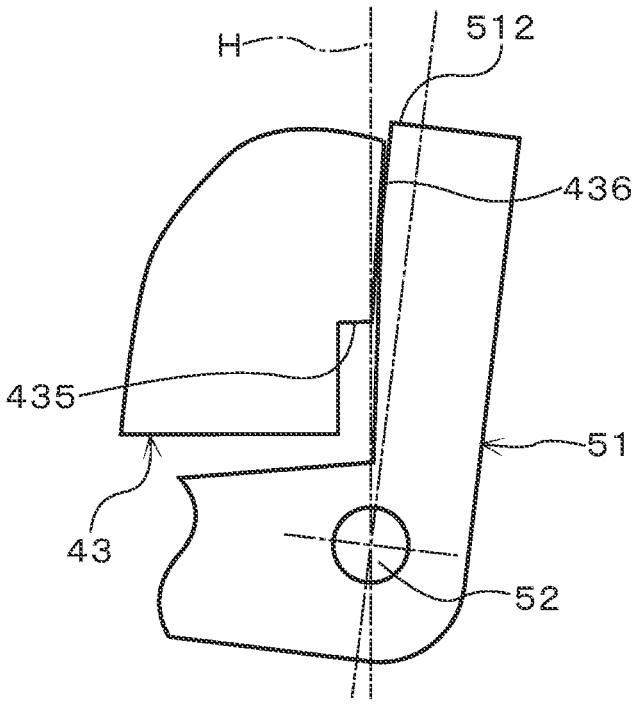
FIG. 12 illustrates one example of an internal structure of the DC circuit breaker in the post-operating state and provides an enlarged view indicating the positional relationship between the locking portion of the latch and the locked portion of the moving block according to one embodiment.

As shown in FIGS. 11 and 12, the center line extending along the moving direction of the moving block 43 and passing through the center of the rotational center of the latch 51, that is, the center of the latch shaft 52 is defined as a center line H. As shown in FIG. 11, when the locking portion 512 of the latch 51 is locking the moving block 43, the locking portion 512 is set in a position displaced in a direction opposite the rotational direction of the operating latch 51 with respect to the central line H. Thus, as the force exerted on the latch 51 from the moving block 43 becomes greater, the rotational force is exerted on the latch 51 in a direction opposite the moving direction of the latch 51 indicated by the white box arrow, that is, in a direction opposite the direction in which the locking portion 512 becomes unlocked. According to such configuration, it becomes possible to reliably lock the latch 51 and thereby prevent the latch 51 from being accidently unlocked when a force other than the operating force of the trigger mechanism 60 is applied to the receiving portion 511 by, for example, oscillation or impact.

As shown in FIGS. 5 and 11, for example, the moving block 43 is provided with a latch guide surface 436. The latch guide surface 436 is a surface that contacts the latch 51 when the moving block 43 moves by the operation of the latch 51. The latch guide surface 436 is formed on a sloped surface in a tapered shape sloped so as to spread in the rotational direction of the latch 51 towards the starting end side from the terminating end side of the direction of movement of the moving block 43. The latch guide surface 436 pushes the latch 51 in the moving direction of the latch 51, that is, in the direction indicated by white box arrow in FIG. 11 to assist the rotation of the latch 51 during the movement of the moving block 43. Thus, the movement of the moving block 43 is prevented from being inhibited by the latch 51 being caught on the moving block 43 during the movement of the moving block 43.

Figure 6:
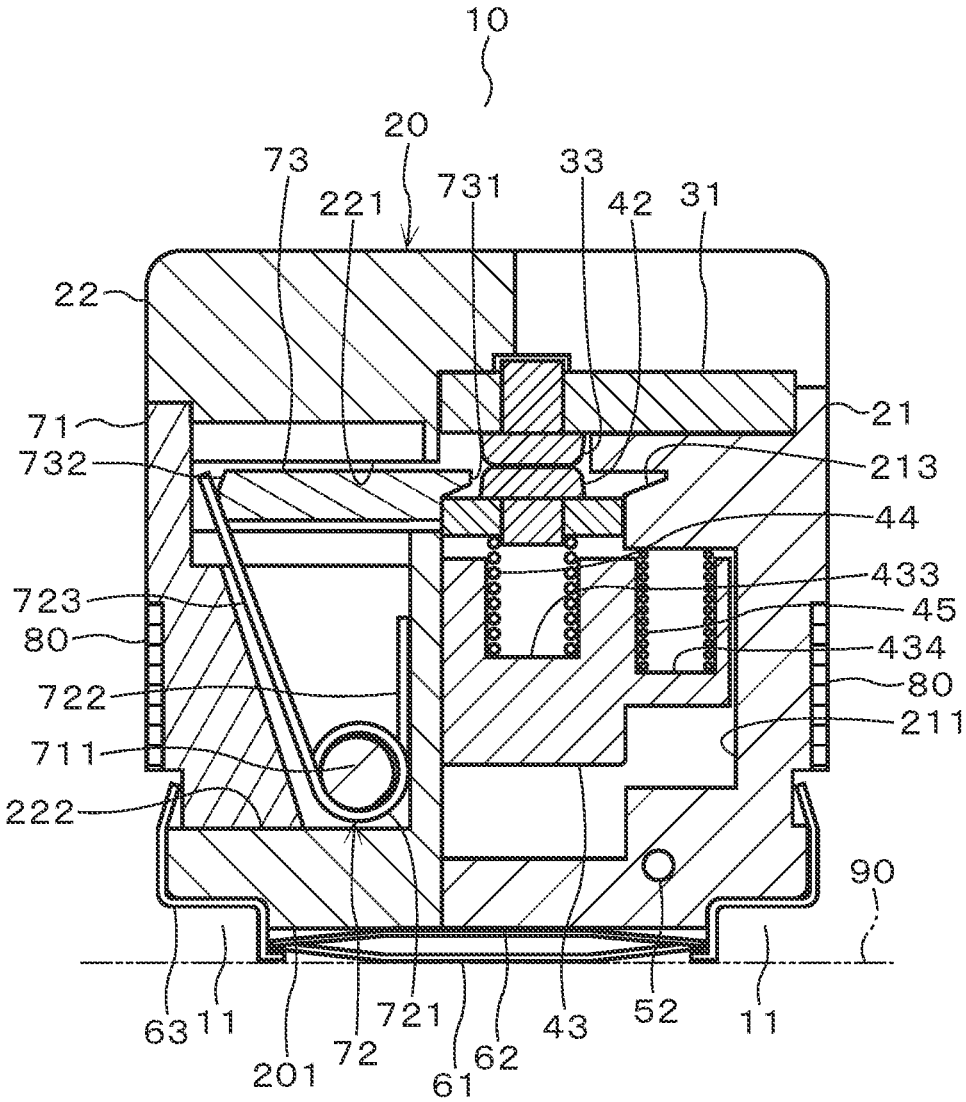
FIG. 6 is a cross sectional view taken along line X6-X6 of FIG. 4 illustrating one example of an internal structure of the DC circuit breaker in the pre-operating state according to one embodiment.

The trigger mechanism 60 is provided in the installation surface 90 side of the DC circuit breaker 10. The trigger mechanism 60 operates the latch 51 to cancel the restriction of the moving block 43 when detecting the abnormal heating of the host device. As shown in FIG. 3, for example, the trigger mechanism 60 is provided with a thermally responsive member 61, a pressing spring 62, and a cover 63. The thermally responsive member 61 is configured by a disc-shaped bimetal, for example. A bimetal formed into a shallow dish shape by a drawing process is used as the thermal responsive member 61 of the present embodiment. As shown in FIGS. 4 to 6, for example, the thermally responsive member 61 is provided at the case 20 so as to oppose the installation surface 90 of the host device and is configured to deform when the installation surface 90 of the host device becomes equal to or greater than a predetermined temperature. In the present embodiment, the thermally responsive member 61 reverses its direction of curvature by snap action. The deformation of the thermally responsive member 61 is conveyed to the receiving portion 511 of the latch 51 to thereby operate the latch 51.

The pressing spring 62 is configured by a plate spring having a round hole formed through its central portion, for example and is provided between the case 20 and the thermally responsive member 61. The pressing spring 62 presses the thermally responsive member 61 towards the installation surface 90 at a load in the magnitude that does not inhibit the deformation of the thermally responsive member 61 by temperature variation. The pressing spring 62 is provided with four legs 621 and the legs 621 press the outer peripheral portion of the thermally responsive member 61 towards the installation surface 90. The number of legs may be three or five or more as long as it is possible to press the thermally responsive member 61 equally at a load in the magnitude that does not affect the operation of the thermally responsive member 61.

The cover 63 is formed of a material with high thermal conductivity, for example, metal material such as an aluminum alloy or copper alloy and is formed into a shallow cylindrical shape. The cover 63 is used to attach the thermal responsive member 61 to the case 20. The cover 63 holds the outer peripheral portion of the thermal responsive member 61 and is attached to the case 20 with the central portion of the thermally responsive member 61 exposed.

When a heating medium having high thermal conductivity and flexibility is provided on the surface of the installation surface 90, the thermally responsive member 61 may be completely covered by the cover 63.

In the present embodiment, the case 20 is provided with a thermally responsive member mount 201. The thermally responsive member mount 201 is formed into a shape that protrudes toward the installation surface 90 when the first case 21 and the second case 22 are put together. The external shape of the thermally responsive member mount 201 is the same as the external shape of the thermally responsive member 61. As shown in FIGS. 4 to 6, for example, when the DC circuit breaker 10 is mounted to the host device, a space 11 is defined between the case 20 and the installation surface 90 of the host device in the periphery of the thermally responsive member mount 201.

The space 11 prevents the case 20 from touching the installation surface 90. Thus, the space 11 serves as a heat insulating layer that prevents transfer of heat from installation surface 90 to the case 20. The heat insulating effect of the space 11 makes it difficult for the case 20 to be affected by the heat from the installation surface 90. That is, it becomes difficult for the heat from the installation surface 90 to be transferred to portions other than the thermally responsive member 61. Thus, it becomes difficult for the thermally responsive member 61 from being affected by the heat accumulated in the case 20, for example. As a result, it becomes possible to detect change in the status of heat of the installation surface 90 more accurately. By delaying the heat transfer from the installation surface 90 to the case 20, it becomes possible to detect the change in the status of heat more reliably by effectively transferring the heat of the installation surface 90 to the thermally responsive member 61 when a sudden temperature elevation occurs. Thus, the DC circuit breaker 10 becomes capable of promptly conducting a cutoff operation when the temperature of the installation surface 90 becomes equal to or greater than a prescribed value.

As shown in FIG. 3, the shutter insertion mechanism 70 is provided with one mounting member 71, two shutter inserting springs 72, and two shutters 73. The mounting member 71 is configured by a material having electrical insulativity such as resin as is the case with the case 20. The material of the mounting member 71 is selected as required from electrically insulative resin such as PPS (Polyphenylene sulfide) resin, UP (unsaturated polyester), PBT (polybutyleneterephtalate), and ABS; and inorganic insulating material such as ceramics depending upon the environment in which the DC circuit breaker 10 is used. As shown in FIGS. 3 and 6, the mounting member 71 is integrally provided with two support shafts 71. The two support shafts 711 extend orthogonally with respect to the moving direction of the moving block 43 and the movable contact 42.

The shutter inserting spring 72 serves as a shutter biasing member that constantly biases the shutter 73 in a direction to be inserted between the fixed contact 33 and the movable contact 42. In the present embodiment, the shutter inserting spring 72 is configured by a torsion spring provided with a coil portion 721, a support arm 722, and an operating arm 723.

The coil portion 721 is a portion formed into a coil shape. The support arm 722 is provided on a first end of the coil portion 721 and is supported by the mounting member 71 or the case 20 which, in this example, is the second case 22. The operating arm 723 is provided on a second end of the coil portion 721 and exerts elastic force on the shutter 73. The shutter inserting spring 72 is mounted on the mounting member 71 with the coil portion 721 inserted into the support shaft 711 of the mounting member 71.

Figure 13:
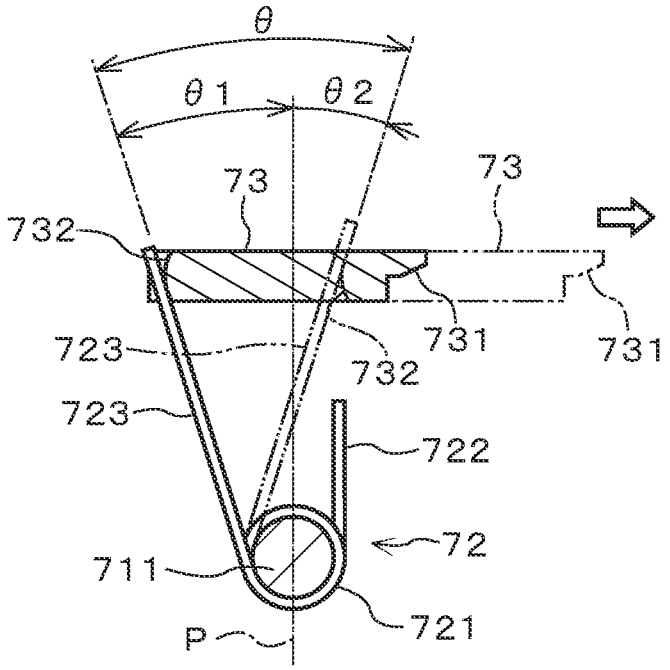
FIG. 13 illustrates the state before and after the operation of a shutter insertion mechanism of the DC circuit breaker according to one embodiment.

As shown in FIG. 13, an axis extending orthogonally with respect to the moving direction of the shutter 73, that is, the direction indicated by the white box arrow in FIG. 13 is defined as an orthogonal axis P. Further, an angle formed by the orthogonal axis P and the operating arm 23 when the shutter 73 is not operating (i.e. prior to the operation of the shutter 73) in which case the shutter 73 is not inserted between the fixed contact 33 and the movable contact 42 is defined as the pre-operation angle θ1. An angle formed by the orthogonal axis P and the operating arm 23 when the shutter 73 is operating (i.e. after the operation of the shutter 73) in which case the shutter 73 is inserted between the fixed contact 33 and the movable contact 42 is defined as the post-operation angle θ2. The shutter inserting spring 72 is stored in the case 20 so that each of the pre-operation angle θ1 and the post-operation angle θ2 is equal to or less than 30 degrees. In other words, the operating arm 23 is within the range of −30 degrees to +30 degrees with respect to orthogonal axis P in both the pre-operation and post-operation states.

It is preferable for the pre-operation angle θ1 and the post-operation angle θ2 to be equal to or less than 20 degrees when downsizing is considered. In the present embodiment, the pre-operation angle θ1 is set to 17 degrees and the post-operation angle θ2 is set to 18 degrees. As a result, the operating angle θ of the operating arm 23 amounts to 35 degrees.

Figure 9:
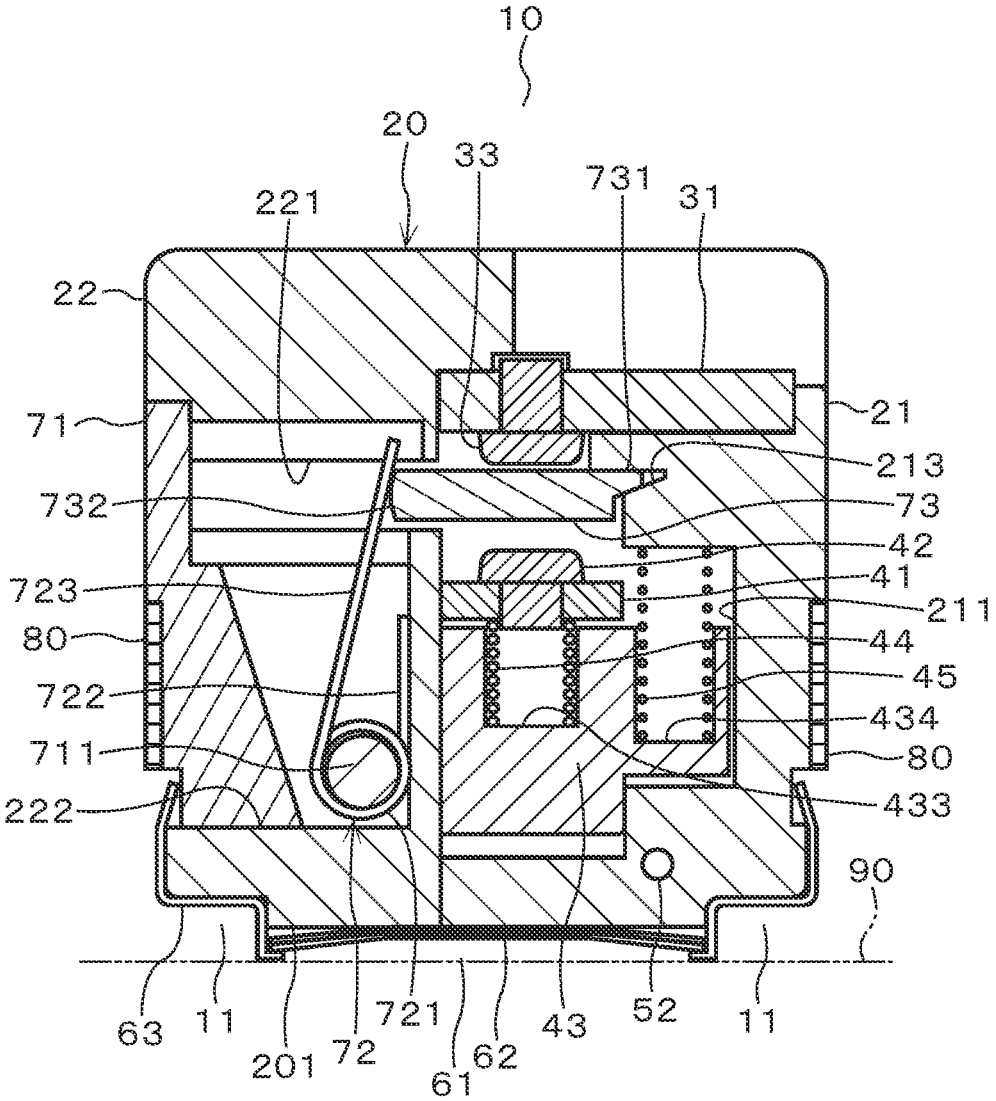
FIG. 9 is a cross sectional view taken along line X9-X9 of FIG. 7 illustrating one example of an internal structure of the DC circuit breaker in the post-operating state according to one embodiment.
Figure 10:
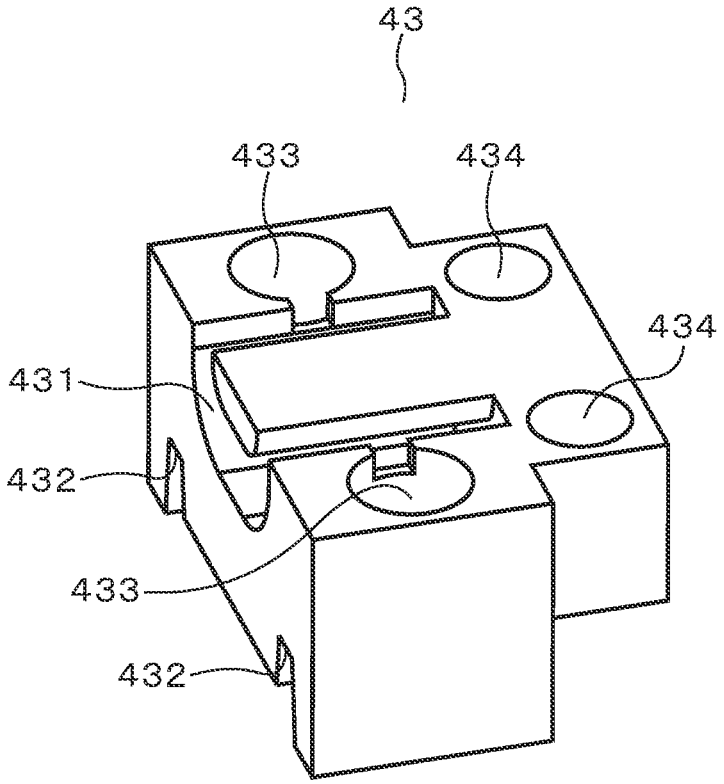
FIG. 10 is a perspective view illustrating one example of a moving block of the DC circuit breaker according to one embodiment.

The two shutters 73 correspond to the two fixed contacts 33 and movable contacts 42, respectively. Similar to the case 20, the shutter 73 is configured by a material having electrically insulativity such as resin. The material of the shutter 73 is selected as required from electrically insulative resin such as PPS (Polyphenylene sulfide) resin, UP (unsaturated polyester), PBT (polybutyleneterephtalate), and ABS; and inorganic insulating material such as ceramics depending upon the environment in which the DC circuit breaker 10 is used. The shutter 73 is formed into a plate shape as a whole and is movably stored inside the case 20, in this case, the second case 22. As shown in FIGS. 6 and 9, the shutter 73 is configured so as to be movable in the orthogonal direction with respect to the moving direction of the moving block 43, that is, the moving direction of the movable contact 42.

The shutter 73 constantly receives elastic force from the shutter inserting spring 72. As shown in FIG. 6, the movement of the shutter 73 is restricted by being locked by the bypass plate 41 when the moving block 43 is in a non-moving state in which the moving block 43 is not moved. On the other hand, as shown in FIG. 9, the locking of the shutter 73 by the bypass plate 41 is canceled in the operating state in which the moving block 43 is moved. Thus, the shutter 73 is moved by the operation of the shutter inserting spring 72 and is inserted between the fixed contact 33 and the movable contact 42 when the movable contact 42 is separated from the fixed contact 33. The two shutters 73 each receives elastic force from different shutter inserting spring 72 and operates independently.

A distal end 731 located in the direction of movement of the shutter 73 is formed in a tapered shape that becomes thinner toward the distal end side. As shown in FIG. 6, the first case 21 of the case 20 is provided with a shutter receiver 213. The shutter receiver 213 is provided on the inner wall of the first case 21 so as to be located on a moving end portion of the shutter 73. The shutter receiver 213 is formed in a tapered groove shape that conforms with the shape of the distal end 731 of the shutter 73.

The moving end of the distal end 731 of the shutter 73 fits into the shutter receiver 213. Thus, the shutter 73 is prevented from bouncing back and temporarily exiting through the fixed contact 33 and the movable contact 42 even when the shutter 73 is moved at high speed.

Figure 14:
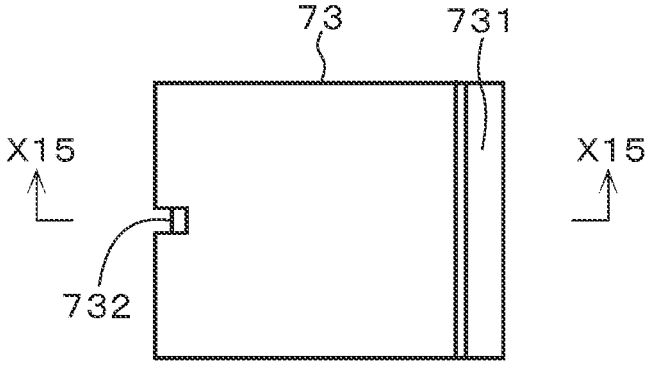
FIG. 14 is a bottom view illustrating one example of a shutter of the DC circuit breaker according to one embodiment.
Figure 15:
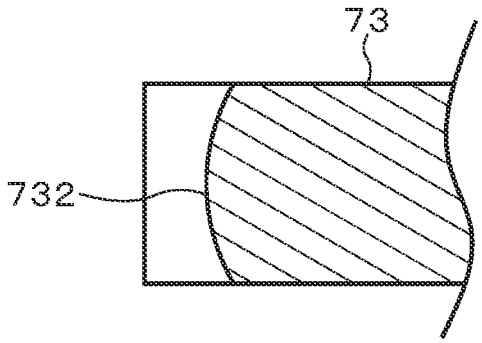
FIG. 15 illustrates one example of a cross-sectional shape taken along line X15-X15 of FIG. 14 of the DC circuit breaker according to one embodiment.
Figure 16:
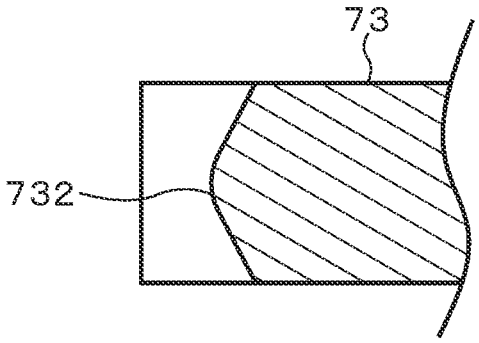
FIG. 16 illustrates another example of a cross-sectional shape taken along line X15-X15 of FIG. 14 of the DC circuit breaker according to one embodiment.

As shown in FIG. 14, the shutter 73 is provided with a cavity 732 that receives the operating arm 723. The cavity 732 is formed by notching the rear end side of the shutter 73 as viewed in the direction of movement of the shutter 73. The operating arm 723 is fitted into the cavity 732. The bottom portion of the cavity 732 is in constant contact with the operating arm 723 and receives elastic force exerted by the shutter inserting spring 72 from the operating arm 723. The bottom portion of the cavity 732, that is, the portion of the cavity 732 that contacts the operating arm 723 is curved along the movement of the operating arm 723 as shown in FIG. 15. Alternatively, the portion of the cavity 732 contacting the operating arm 723 may be sloped along the operating arm 723 as shown in FIG. 16. Because the cavity 732 is curved or sloped, a smooth contact is established between the operating arm 723 and the cavity 732 when the shutter 73 is moved.

The second case 22 of the case 20 is provided with a shutter housing 221 and a mounting member housing 222. As shown in FIGS. 4 and 6, for example, the shutter housing 221 formed into a groove shape that extends through the second case 22 and determines the moving direction of the shutter 73. That is, the shutter 73 is moved by being guided by the peripheral wall of the shutter housing 221 with the shutter 73 being stored in the shutter housing 221. The shutter housing 221 communicates with the outside of the second case 22. Thus, the shutter 73 is capable of being inserted into the shutter housing 221 from the outside of the second case 22.

As shown in FIG. 6, the mounting member housing 222 is formed by caving the outer side of the second case 22. Thus, the mounting member 71 is configured so as to be capable of being inserted into the mounting member housing 222 along with the shutter inserting spring 72 from the outside of the second case 22 with the shutter inserting spring 72 being mounted on the support shaft 711.

A securing ring 80 secures the cases 21 and 22 divided in two and the mounting member 71 in an assembled state. The securing ring 80 is formed into an annular shape, in this case, a cylindrical shape by a metal material such as an aluminum alloy or bronze. The first case 21, the second case 22, and the mounting member 71 are inserted to the inner side of the securing ring 80 in an assembled state. The first case 21, the second case 22, and the mounting member 71 are secured to one another by swaging the securing ring 80.

At least either of the case 20 and the mounting member 71 is provided with a swage receiving portion. In the present embodiment, the first case 21 of the case 20 is provided with a swage receiving portion 214 as shown in FIG. 5. Further, the mounting member 71 is provided with a swage receiving portion 712. The swage receiving portions 214 and 712 are portions being deformed when swaging the securing ring 80. The swage receiving portions 214 and 712 are provided on the periphery of the case 20 at locations opposing one another. That is, in the present embodiment, the securing ring 80 is swaged at two locations opposing one another on the periphery of the case 20.

The swage receiving portion 712 is formed by circularly caving the mounting member 71 towards the inner side from the outer side. The swage receiving portion 214 is formed by circularly penetrating the first case to the inner side from the outer side. The swage receiving portion 214 is provided in a position corresponding to the locking portion 512 of the latch 51. Thus, the swage receiving portion 214 serves as a window penetrating the case 20 and rendering the locking state of the locking portion 512 and the moving block 43 inside the case 20 visible from the outside of the case 20. The window 214 is covered by the securing ring 80.

Next, a description will be given on an assembly method of the DC circuit breaker 10.

When assembling the DC circuit breaker 10, the worker is to first mount the fixed electrode mechanism 30, the movable electrode mechanism 40, and the latch mechanism 50 to the first case 21. Then, the worker is to combine the first case 21, having the fixed electrode mechanism 30, the movable electrode mechanism 40, and the latch mechanism 50 mounted thereto with the second case 22. Thereafter, the worker is to mount the trigger mechanism 60 to the case 20 with the first case 21 and the second case 22 combined and insert the shutter inserting mechanism 70 into the shutter housing 221 and the mount member housing 222 of the second case 22 from the outside of the case 20.

Then, the user is to visually confirm the locking state of the locking portion 512 of the latch 51 and the locked portion 435 of the moving block 43 through the window 214 which also serves as the swage receiving portion. In case there is no problem in the locking status of locking portion 512 of the latch 51 and the locked portion 435 of the moving block 43, the securing ring 80 is fitted to the case 20, whereafter the securing ring 80 is swaged to secure the first case 21, the second case 22, and the mounting member 71 with one another. The above described procedures are carried out to complete assembly of the DC circuit breaker 10.

Next, a description will be given on the operation of the DC circuit breaker 10. The DC circuit breaker 10 is placed in non-operating state, that is, in a state in which the installation surface 90 of the host device is less than a prescribed temperature as shown in FIGS. 4 to 6 when the installation surface 90 of the host device is not abnormally overheated. When the DC circuit breaker 10 is in the non-operating state, the movable contact 42 is placed in contact with the fixed contact 33. Thus, the two fixed contacts 33 are placed in a conductive state, that is, a closed state by the movable contact 42 and the bypass plate 41.

In the present embodiment, the bypass plate 41 is receives elastic force of the pressure spring 44 and is pressed toward the fixed contact 33 side. In the groove 431 in which the bypass plate 41 is inserted, a gap is defined in the moving direction of the moving block 43 when the bypass plate 41 is inserted into the groove 431. Thus, the movement of the bypass plate 41 towards the fixed contact 33 side is not inhibited by the groove 431 of the moving block 43 and therefore it is possible to more reliably place the movable contact 42 and the fixed contact 33 provided to the bypass plate 41 in intimate contact.

Figure 8:
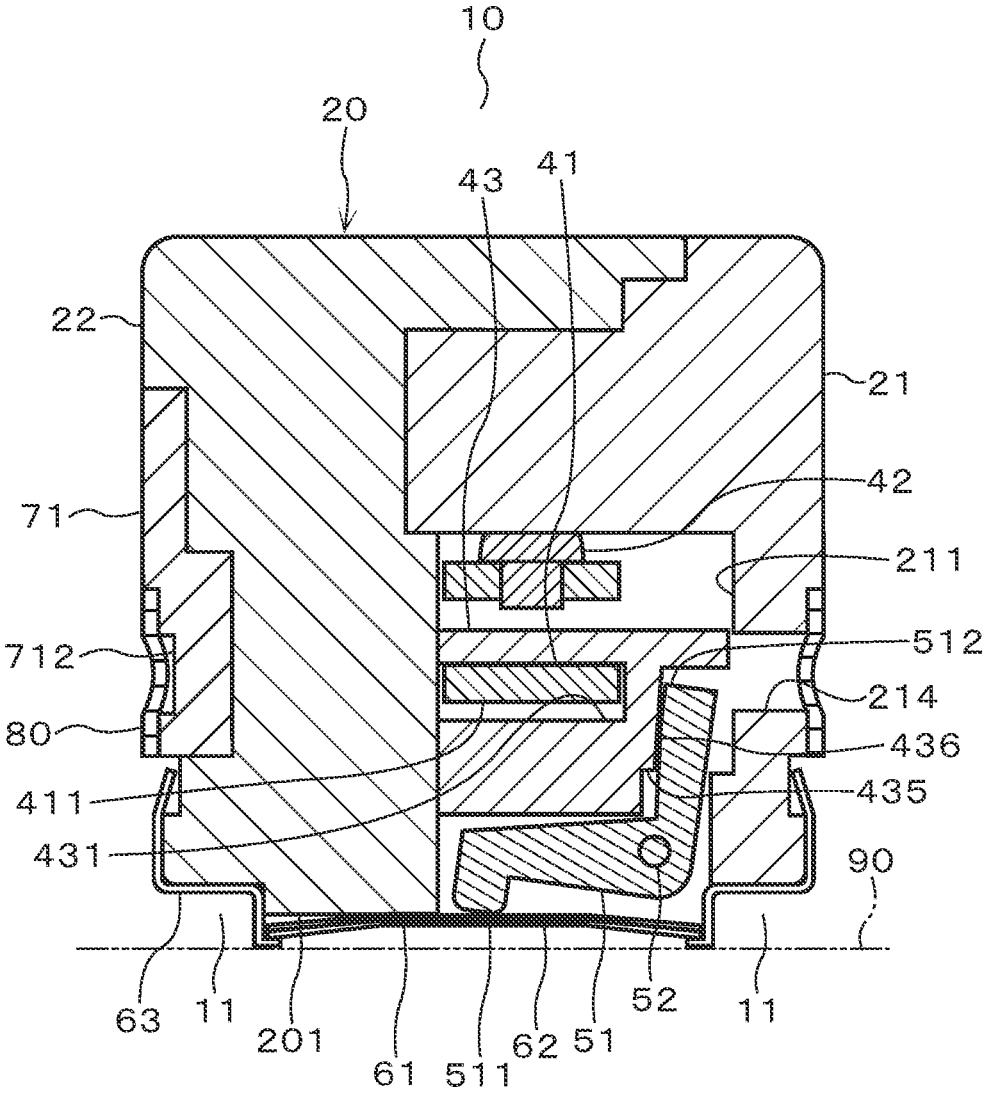
FIG. 8 is a cross sectional view taken along line X8-X8 of FIG. 7 illustrating one example of an internal structure of the DC circuit breaker in the post-operating state according to one embodiment.

When the installation surface 90 of the host device is abnormally overheated to a prescribed temperature or greater, the DC circuit breaker 10 is placed in the operating state as shown in FIGS. 7 to 9, and the circuit is cut off. When the installation surface 90 of the host device is abnormally overheated to a prescribed temperature or greater, the thermally responsive member 61 of the trigger mechanism 60 becomes deformed and the deformation of the thermally responsive member 61 causes the receiving portion 511 of the latch 51 to be pressed. As a result, the latch 51 rotates about the latch shaft 52 and thereby cancels the locking of the locking portion 512 with the locked portion 435 of the moving block 43 to allow the movement of the moving block 43. Then, the moving block 43 moves in the direction moving away from the fixed contact 33 by the elastic force of the separating spring 45. Hence, the movable contact 42 provided to the bypass plate 41 is moved in the direction to move away from the fixed contact 33 along with moving block 43 and the movable contact 42 is separated from the fixed contact 33. As a result, the two fixed contacts 33 become no longer conductive and thus, become opened. By opening the circuit through which a high-voltage DC current flows, an arc may be generated between the fixed contact 33 and the movable contact 42.

Thereafter, when the bypass plate 41 is moved along with the moving block 43, locking of the bypass plate 41 with the shutter 73 becomes canceled to allow the movement of the shutter 73. Then, the shutter 73 becomes inserted between the fixed contact 33 and the movable contact 42 by the operation of elastic force of the shutter inserting spring 72. The circuit is closed by the distancing of the fixed contact 33 and the movable contact 42 and the insertion of the insulating shutter 73 between the fixed contact 33 and the movable contact 42. The arc generated between the fixed contact 33 and the movable contact 42 is reliably extinguished by being sandwiched between the distal end 731 of the shutter 73 and the inner surface of the case 20 and being cutoff.

According to the embodiment described above, the DC circuit breaker 10 is provided with the case 20, two fixed contacts 33, two movable contacts 42, the bypass plate 41, the moving block 43, the separating spring 45, the thermally responsive member 61, the latch 51, the shutter 73, and the shutter inserting spring 72.

The case 20 is configured by an electrically insulative material. The fixed contact 33 is fixed within the case 20. The movable contact 42 is provided so as to correspond to each of the two fixed contacts 33. The bypass plate 41 has two movable contacts 42 fixed thereto and electrically connects the two movable contacts 42. The moving block 43 is provided with a groove 431 in which the bypass plate 41 is disposed and is provided movably within the case 20 in a direction moving away from the fixed contact 33. The movement of the moving block 43 in the direction to move away from the fixed contacts 33 causes the bypass plate 41 to move away from the fixed contact 33.

The separating spring 45 constantly exerts elastic force on the moving block 43 in a direction to move away from the moving block 43 and serves as a moving block biasing member. The thermally responsive member 61 is provided in a position opposing the installation surface 90 and deforms when the installation surface 90 becomes equal to or greater than a prescribed temperature. The latch 51 is provided with the locking portion 512. When the thermally responsive member 61 is in the pre-deformation state, that is, in the non-operating state, the locking portion 512 restricts the movement of the moving block 43 by locking the moving block 43. The latch 51 operates in response to the deformation of the thermally responsive member 61 to cause the locking portion 512 to unlock from the moving block 43 and thereby cancel the restriction of the movement of the moving block 43.

The shutter 73 is configured by an electrically insulative material and is inserted between the fixed contact 33 and the movable contact 42 when the movable contact 42 is separated from the fixed contact 33. The shutter inserting spring 72 constantly exerts elastic force on the shutter 73 in a direction to cause the shutter 73 to be inserted between the fixed contact 33 and the movable contact 42 and serves as a shutter biasing member.

According to the above described configuration, when the host device is abnormally overheated, the movable contact 42 is forcibly separated from the fixed contact 33 and the shutter 73 having electrical insulativity is inserted between the movable contact 42 and the fixed contact 33. Thus, the arc generated between the movable contact 42 and the fixed contact 33 is reliably extinguished to thereby reliably cut off current flowing between the fixed contacts 33.

It may be conceived to use parts such as a shaft to render the bypass plate 41, having movable contacts 42 fixed thereto, movably. However, parts such as a shaft requires lots of assembly work such as passing the shaft through a cylindrical hole and fixing both ends of the shaft with a fixing member or the like. In contrast, according to the present embodiment, the bypass plate 41, having movable contacts 42 fixed thereto, has a curved portion 411 curved in a U shape, and the bypass plate 41 is mounted to the moving block 43 by inserting the curved portion 411 into the U-shaped groove 431 provided to the moving block 43. Thus, there is no need to use parts such as shaft to render the bypass plate 41, having movable contacts fixed thereto, movably. Thus, by reducing the number of parts, it is possible to realize downsizing and reducing assembly work. As a result, according to the present embodiment, it is possible to reliably cut off current and achieve downsizing and productivity improvement.

The shutter inserting spring 72 is configured by a torsion spring having the support arm 722 and the operating arm 723 on the ends of the coil-shaped coil portion 721. The support arm 722 is provided on the first end of the coil portion 721 and is supported by the mounting member 71 or the case 20. The operating arm 723 is provided on the second end of the coil portion 721 and exerts elastic force on the shutter 73. The shutter inserting spring 72 is stored within the case 20 so that the pre-operation angle θ1 and the post-operation angle θ2 are both equal to or less than 30 degrees. The pre-operation angle θ1 represents the angle formed by orthogonal axis P, arranged orthogonally with the moving direction of the shutter 73, and the operating arm 723 when the shutter 73 is in the non-operating state and the post-operation angle θ2 represents the angle formed by orthogonal axis P, arranged orthogonally with the moving direction of the shutter 73, and the operating arm 723 when the shutter 73 is in the operating state.

It is thus, possible to reduce the space for mounting the shutter inserting spring 72 and thereby further reduce the size of the DC circuit breaker 10.

As shown in FIGS. 14 to 16, the shutter 73 is provided with the cavity 732. The cavity 732 receives the operating arm 723 and the portion of the cavity 732 contacting the operating arm 723 is sloped or curved along the operating arm 723. Thus, the area of contact between the operating arm 723 and the shutter 73 becomes greater compared to the case in which the rear end of the shutter 73, that is, the contact site with the operating arm 723 is configured to form a right angle. Hence, it is possible to efficiently exert the elastic force of the shutter inserting spring 72 on the shutter 73. As a result, it is possible to reliably operate the shutter 73 while reducing the size of the shutter inserting spring 72 and moreover, downsize the DC circuit breaker 10 as a whole.

The DC circuit breaker 10 is further provided with the mounting member 71 to which the shutter inserting spring 72 is mounted. Further, the case 20 is provided with the shutter housing 221 and the mounting member housing 222. The shutter housing 221 is configured so as to be capable of storing the shutter 73, inserted from outside the case 20, into the case 20. The mounting member housing 222 is configured so as to be capable of storing the shutter inserting spring 72 and the mounting member 71 attached thereto, inserted from outside the case, into the case 20.

It is thus, possible to mount the shutter inserting spring 72 and the shutter 73 from the outside of the case 20. This facilitates the mounting of the shutter inserting spring 72 and the shutter 73 and thereby further improves the productivity of the DC circuit breaker 10.

The mounting member 71 is formed of electrically insulative material such as resin and is integrally provided with the support shaft 711 supporting the coil portion 721 of the shutter inserting spring 72. It is thus, not required to assemble the support shaft 711 and thereby further improve the productivity of the DC circuit breaker 10. The material of the case is selected as appropriate depending upon the environment in which the DC circuit breaker 10 is used from materials such as PPS (Polyphenylene sulfide) resin, UP (unsaturated polyester), PBT (polybutyleneterephtalate), and ABS; and inorganic insulating material such as ceramics, for example.

Further, the DC circuit breaker 10 is provided with two pressure springs 44. The two pressure springs 44 each correspond to each of the movable contacts 42. The pressure spring 44 are provided on the bypass plate 41 so as to be located on the side opposite the fixed contacts 33 and are provided between the bypass plate 41 and the moving block 43. The two pressure springs 44 serve as the movable contact biasing member that bias each of the two movable contacts 42 provided on the bypass plate 41 in a direction to press each of the fixed contacts 33.

That is, the DC circuit breaker 10 is provided with two pressure springs 44 each corresponding to each of the two movable contacts 42. It is thus, possible to reliably place the movable contacts 42 provided on the bypass plate 41 in intimate contact with the fixed contacts 33. Hence, it is possible to prevent the movable contacts 42 from readily separating from the fixed contacts 33 by oscillation or the like occurring under normal use and as a result, reliably prevent the DC circuit breaker 10 from opening by malfunctioning of the DC circuit breaker 10 such as oscillation occurring under normal use.

The elastic force of the pressure spring 44 is set to be greater than the elastic force of the separating spring 45. Thus, at the initial stage of movement of the moving block 43, the pressure spring 44 exerts a force in a direction to cancel the rotational force of the separating spring 45. Hence, at the initial stage of movement of the moving block 43, the rotation of the moving block 43 is inhibited. As a result, the moving block 43 is prevented from being caught on the inner wall of the moving block housing 211 to thereby smoothen the movement of the moving block 43.

When the moving block 43 is locked by the locking portion 512 of the latch 51, the locking portion 512 is displaced in the direction opposite the direction of rotation of the latch 51 in the operating state with respect to the central line H extending along the moving direction of the moving block 43 and passing through the latch shaft 52 which serves as the center of rotation of the latch 51. Thus, as the force exerted on the latch 51 from the moving block 43 becomes greater, rotational force is exerted on the latch 51 in the direction opposite the direction of movement of the latch 51 indicated by the white box arrow indicated in FIG. 10, that is, in the direction opposite the direction in which the locking of the locking portion 512 becomes unlocked, in other words, in the direction in which the locking between the locking portion 512 and the locked portion 435 become stronger. According to such configuration, it is possible to establish the lock between the locking portion 512 and the locked portion 435 more reliably and thereby prevent the latch 51 from being accidently unlocked by oscillation, or the like occurring under normal use by the force exerted on the latch 51 from the moving block 43.

The case 20 is configured by combining multiple sub-cases, in this case, two sub-cases, namely, the first case 21 and the second case 22. The first case 21 and the second case 22 constituting the case 20 are secured with one another by being inserted through a securing ring 80 formed into an annular shape and swaging the securing ring 80. It is thus, possible to obviate the need for fastening members such as a bolt and a nut for assembling the first case 21 and the second case 22 and thereby reduce the number of parts while obviating the need for providing a space for providing the fastening members. Further, because the first case 21 and the second case 22 may be assembled by swaging the securing ring 80, there is no need to mount the fastening members and thereby reduce the assembly work and improve productivity.

The case 20 is provided with the window 214. The window 214 penetrates the case 20 and allows the locking portion 512 of the latch 51 provided inside the case 20 to be visible from outside the case 20. The securing ring 80 is provided in a position to cover the window 214.

Thus, the worker is allowed to check the locking state of the latch 51 and the moving block 43 through the window 214 up to the point when the securing ring 80 is mounted to complete the assembly of the DC circuit breaker 10. Thus, when the latch 51 and the moving block 43 become unlocked due to oscillation, or the like, which occurred during assembly for example, it is possible to promptly confirm that unlocking has occurred by viewing the inside of the case 20 through the window 214. It is thus, possible to reliably find a failure at the time of assembly in which the assembly is being carried out with the latch 51 and the moving block 43 unlocked, that is, assembly is carried out with the movable contact 42 and the fixed contact 33 opened and thereby prevent such defective product from being released to the market.

The securing ring 80 is provided in a position to cover the window 214. It is thus, possible to prevent the user from accidently touching the latch 51 inside the case 20 through the window 214 to cause the latch 51 to be unlocked and thereby prevent the DC circuit breaker 10 from operating unintentionally.

The case 20 is provided with the thermally responsive member mount 201. The thermally responsive member mount 201 is a portion to which the thermally responsive member 61 is mounted and is formed so as to protrude toward the installation surface 90. In the periphery of the thermally responsive member mount 201, the space 11 is defined between the case 20 and the installation surface.

Thus, it is possible to make it difficult for the case 20 to be affected by the heat coming from the installation surface 90 by the operation of the space 11. That is, because it becomes difficult for the heat from the installation surface 90 to be transferred to portions other than the thermally responsive member 61, it becomes difficult for the thermally responsive member 61 from being affected by the heat accumulated in the case 20, for example, and thereby allow the variation of heat of the installation surface 90 to be detected more accurately. That is, by delaying the heat transfer from the installation surface 90 to the case 20, it is possible to detect the variation of heat more accurately by efficiently transferring the heat of the installation surface 90 to the thermally responsive member 61 when a sudden temperature elevation occurs. Thus, it is possible for the DC circuit breaker 10 to promptly execute a cutoff operation when the temperature of the installation surface 90 is elevated to a prescribed temperature or greater.

The movable contact biasing member 44, the moving block biasing member 45, and the shutter biasing member 72 are not limited to a spring, but may be replaced by an elastic material such as rubber as long as the same functionalities can be provided.

In the present embodiment, the case 20, the mounting member 71, and the shutter 73 are configured by electrically insulative resin materials. However, the materials need not be the same, but may be a combination of different types of materials. The electrically insulative materials constituting the case 20, the mounting member 71, and the shutter 73 are selected as required from PBT, PPS (Polyphenylene sulfide)

resin, UP (unsaturated polyester), and ABS; and inorganic insulating material such as ceramics, for example.

The foregoing embodiment has been presented by way of example only, and is not intended to limit the scope of the invention. Indeed, the novel embodiments described herein may be embodied in a variety of other forms; furthermore, various omissions, substitutions and changes in the form of the embodiment described herein may be made without departing from the spirit of the invention. The accompanying claims and their equivalents are intended to cover such forms or modifications as would fall within the scope and gist of the invention.

The invention claimed is:

1. A DC circuit breaker comprising:

a case formed of an electrically insulative material;

two fixed contacts fixed within the case;

two movable contacts each provided so as to correspond to each of the two fixed contacts;

a bypass plate having the two movable contacts fixed thereto and electrically connecting the two movable contacts;

a moving block having a groove in which the bypass plate is disposed and being provided so as to be movable in a direction to move away from the fixed contacts within the case, the moving block being configured to move the bypass plate in a direction to move away from the fixed contacts when moving in the direction to move away from the fixed contacts;

a moving block biasing member configured to constantly bias the moving block in the direction to move away from the fixed contacts;

a thermally responsive member provided in a position opposing an installation surface and configured to deform when the installation surface becomes equal to or greater than a prescribed temperature;

a latch having a locking portion configured to restrict movement of the moving block by locking the moving block when the thermally responsive member is in a pre-deformation state, the latch being configured to operate to cancel the restricted movement of the moving block by unlocking the locking portion from the moving block in response to a deformation of the thermally responsive member;

a shutter formed of an electrically insulative material and configured to be inserted between the fixed contacts and the movable contacts when the movable contacts are separated from the fixed contacts; and a shutter biasing member configured to constantly bias the shutter in a direction to be inserted between the fixed contacts and the movable contacts, wherein the groove exhibits a U shape formed by digging the moving block and has two inner surfaces facing each other, each of which are formed in a U shape, and wherein the bypass plate is provided with a curved portion curved in a U shape and provided between the two movable contacts, the curved portion being disposed inside the groove.

2. A DC circuit breaker comprising:

a case formed of an electrically insulative material;

two fixed contacts fixed within the case;

two movable contacts each provided so as to correspond to each of the two fixed contacts;

a bypass plate having the two movable contacts fixed thereto and electrically connecting the two movable contacts;

a moving block having a groove in which the bypass plate is disposed and being provided so as to be movable in a direction to move away from the fixed contacts within the case, the moving block being configured to move the bypass plate in a direction to move away from the fixed contacts when moving in the direction to move away from the fixed contacts;

a moving block biasing member configured to constantly bias the moving block in the direction to move away from the fixed contacts;

a thermally responsive member provided in a position opposing an installation surface and configured to deform when the installation surface becomes equal to or greater than a prescribed temperature;

a latch having a locking portion configured to restrict movement of the moving block by locking the moving block when the thermally responsive member is in a pre-deformation state, the latch being configured to operate to cancel the restricted movement of the moving block by unlocking the locking portion from the moving block in response to a deformation of the thermally responsive member;

a shutter formed of an electrically insulative material and configured to be inserted between the fixed contacts and the movable contacts when the movable contacts are separated from the fixed contacts; and a shutter biasing member configured to constantly bias the shutter in a direction to be inserted between the fixed contacts and the movable contacts, wherein the shutter biasing member comprises a torsion spring having a coil portion formed into a coil shape and an operating arm configured to exert elastic force to the shutter, wherein the shutter biasing member is stored inside the case so that an angle formed by an orthogonal axis orthogonal to a moving direction of the shutter and the operating arm is equal to or less than 30 degrees when the shutter is in an operating state and a non-operating state, and wherein the shutter is provided with a cavity sloped or curved along the operating arm at a portion contacting the operating arm.

3. A DC circuit breaker comprising:

a case formed of an electrically insulative material;

two fixed contacts fixed within the case;

two movable contacts each provided so as to correspond to each of the two fixed contacts;

a bypass plate having the two movable contacts fixed thereto and electrically connecting the two movable contacts;

a moving block having a groove in which the bypass plate is disposed and being provided so as to be movable in a direction to move away from the fixed contacts within the case, the moving block being configured to move the bypass plate in a direction to move away from the fixed contacts when moving in the direction to move away from the fixed contacts;

a moving block biasing member configured to constantly bias the moving block in the direction to move away from the fixed contacts;

a thermally responsive member provided in a position opposing an installation surface and configured to deform when the installation surface becomes equal to or greater than a prescribed temperature;

a latch having a locking portion configured to restrict movement of the moving block by locking the moving block when the thermally responsive member is in a pre-deformation state, the latch being configured to operate to cancel the restricted movement of the moving block by unlocking the locking portion from the moving block in response to a deformation of the thermally responsive member;

a shutter formed of an electrically insulative material and configured to be inserted between the fixed contacts and the movable contacts when the movable contacts are separated from the fixed contacts; and a shutter biasing member configured to constantly bias the shutter in a direction to be inserted between the fixed contacts and the movable contacts, and a mounting member to which the shutter biasing member is mounted, wherein the case is provided with a shutter housing configured to receive insertion of the shutter from outside the case and configured to be capable of storing the shutter into the case and a mounting member housing configured to receive insertion of the mounting member having the shutter biasing member mounted thereto and configured to be capable of storing the shutter biasing member and the mounting member into the case.

4. The DC circuit breaker according to claim 3, wherein the mounting member comprises a resin and is integrally provided with a support shaft configured to support the coil portion of the shutter biasing member.

5. A DC circuit breaker comprising:

a case formed of an electrically insulative material;

two fixed contacts fixed within the case;

two movable contacts each provided so as to correspond to each of the two fixed contacts;

a bypass plate having the two movable contacts fixed thereto and electrically connecting the two movable contacts;

a moving block having a groove in which the bypass plate is disposed and being provided so as to be movable in a direction to move away from the fixed contacts within the case, the moving block being configured to move the bypass plate in a direction to move away from the fixed contacts when moving in the direction to move away from the fixed contacts;

a moving block biasing member configured to constantly bias the moving block in the direction to move away from the fixed contacts;

a thermally responsive member provided in a position opposing an installation surface and configured to deform when the installation surface becomes equal to or greater than a prescribed temperature;

a latch having a locking portion configured to restrict movement of the moving block by locking the moving block when the thermally responsive member is in a pre-deformation state, the latch being configured to operate to cancel the restricted movement of the moving block by unlocking the locking portion from the moving block in response to a deformation of the thermally responsive member;

a shutter formed of an electrically insulative material and configured to be inserted between the fixed contacts and the movable contacts when the movable contacts are separated from the fixed contacts;

a shutter biasing member configured to constantly bias the shutter in a direction to be inserted between the fixed contacts and the movable contacts; and two movable contact biasing members provided so as to correspond to the two movable contacts and located on the bypass plate on a side opposite the two fixed contacts so as to be located between the bypass plate and the moving block, the two movable contact biasing members being configured to bias the two movable contacts provided on the bypass plate in a direction to be pressed to the two fixed contacts, wherein a biasing force of the two movable contact biasing members is set to be greater than a biasing force of the moving block biasing member.

6. A DC circuit breaker comprising:

a case formed of an electrically insulative material;

two fixed contacts fixed within the case;

two movable contacts each provided so as to correspond to each of the two fixed contacts;

a bypass plate having the two movable contacts fixed thereto and electrically connecting the two movable contacts;

a moving block having a groove in which the bypass plate is disposed and being provided so as to be movable in a direction to move away from the fixed contacts within the case, the moving block being configured to move the bypass plate in a direction to move away from the fixed contacts when moving in the direction to move away from the fixed contacts;

a moving block biasing member configured to constantly bias the moving block in the direction to move away from the fixed contacts;

a thermally responsive member provided in a position opposing an installation surface and configured to deform when the installation surface becomes equal to or greater than a prescribed temperature;

a latch having a locking portion configured to restrict movement of the moving block by locking the moving block when the thermally responsive member is in a pre-deformation state, the latch being configured to operate to cancel the restricted movement of the moving block by unlocking the locking portion from the moving block in response to a deformation of the thermally responsive member;

a shutter formed of an electrically insulative material and configured to be inserted between the fixed contacts and the movable contacts when the movable contacts are separated from the fixed contacts;

a shutter biasing member configured to constantly bias the shutter in a direction to be inserted between the fixed contacts and the movable contacts, wherein when the locking portion is locking the moving block, the locking portion is displaced in a direction opposite a rotational direction of the latch with respect to a central line extending along a moving direction of the moving block and passing through a rotational center of the latch.

7. A DC circuit breaker comprising:

a case formed of an electrically insulative material;

two fixed contacts fixed within the case;

two movable contacts each provided so as to correspond to each of the two fixed contacts;

a bypass plate having the two movable contacts fixed thereto and electrically connecting the two movable contacts;

a moving block having a groove in which the bypass plate is disposed and being provided so as to be movable in a direction to move away from the fixed contacts within the case, the moving block being configured to move the bypass plate in a direction to move away from the fixed contacts when moving in the direction to move away from the fixed contacts;

a moving block biasing member configured to constantly bias the moving block in the direction to move away from the fixed contacts;

a thermally responsive member provided in a position opposing an installation surface and configured to deform when the installation surface becomes equal to or greater than a prescribed temperature;

a latch having a locking portion configured to restrict movement of the moving block by locking the moving block when the thermally responsive member is in a pre-deformation state, the latch being configured to operate to cancel the restricted movement of the moving block by unlocking the locking portion from the moving block in response to a deformation of the thermally responsive member;

a shutter formed of an electrically insulative material and configured to be inserted between the fixed contacts and the movable contacts when the movable contacts are separated from the fixed contacts;

a shutter biasing member configured to constantly bias the shutter in a direction to be inserted between the fixed contacts and the movable contacts, wherein the case is configured by combining a plurality of divided parts, wherein the parts constituting the case are secured together by swaging an annularly shaped securing ring with the parts inserted through the annularly shaped securing ring.

8. A DC circuit breaker comprising:

a case formed of an electrically insulative material;

two fixed contacts fixed within the case;

two movable contacts each provided so as to correspond to each of the two fixed contacts;

a bypass plate having the two movable contacts fixed thereto and electrically connecting the two movable contacts;

a moving block having a groove in which the bypass plate is disposed and being provided so as to be movable in a direction to move away from the fixed contacts within the case, the moving block being configured to move the bypass plate in a direction to move away from the fixed contacts when moving in the direction to move away from the fixed contacts;

a moving block biasing member configured to constantly bias the moving block in the direction to move away from the fixed contacts;

a thermally responsive member provided in a position opposing an installation surface and configured to deform when the installation surface becomes equal to or greater than a prescribed temperature;

a latch having a locking portion configured to restrict movement of the moving block by locking the moving block when the thermally responsive member is in a pre-deformation state, the latch being configured to operate to cancel the restricted movement of the moving block by unlocking the locking portion from the moving block in response to a deformation of the thermally responsive member;

a shutter formed of an electrically insulative material and configured to be inserted between the fixed contacts and the movable contacts when the movable contacts are separated from the fixed contacts;

a shutter biasing member configured to constantly bias the shutter in a direction to be inserted between the fixed contacts and the movable contacts, wherein the case is provided with a window penetrating from an outside of the case to the locking portion.

9. The DC circuit breaker according to claim 8, wherein the case is configured by combining a plurality of divided parts, wherein the parts constituting the case are secured together by swaging the securing ring with the parts inserted through an annularly shaped securing ring, and wherein the annularly shaped securing ring is provided in a position to cover the window penetrating from an outside of the case.

10. A DC circuit breaker comprising:

a case formed of an electrically insulative material;

two fixed contacts fixed within the case;

two movable contacts each provided so as to correspond to each of the two fixed contacts;

a bypass plate having the two movable contacts fixed thereto and electrically connecting the two movable contacts;

a moving block having a groove in which the bypass plate is disposed and being provided so as to be movable in a direction to move away from the fixed contacts within the case, the moving block being configured to move the bypass plate in a direction to move away from the fixed contacts when moving in the direction to move away from the fixed contacts;

a moving block biasing member configured to constantly bias the moving block in the direction to move away from the fixed contacts;

a thermally responsive member provided in a position opposing an installation surface and configured to deform when the installation surface becomes equal to or greater than a prescribed temperature;

a latch having a locking portion configured to restrict movement of the moving block by locking the moving block when the thermally responsive member is in a pre-deformation state, the latch being configured to operate to cancel the restricted movement of the moving block by unlocking the locking portion from the moving block in response to a deformation of the thermally responsive member;

a shutter formed of an electrically insulative material and configured to be inserted between the fixed contacts and the movable contacts when the movable contacts are separated from the fixed contacts;

a shutter biasing member configured to constantly bias the shutter in a direction to be inserted between the fixed contacts and the movable contacts, wherein the thermally responsive member is closer to the installation surface than the case is to the installation surface, wherein the case is provided with a thermally responsive member mount protruding towards the installation surface and to which the thermally responsive member is mounted, wherein the contour of the thermally responsive member mount matches the contour of the thermally responsive member, and wherein a space is defined between the case and the installation surface in a periphery of the thermally responsive member mount.

* * * * *